United States Patent [19]

Kohler

[11] Patent Number: 4,733,713

[45] Date of Patent: Mar. 29, 1988

[54] PLASTIC PATTERN CASTING SYSTEM AND METHOD OF CASTING

[75] Inventor: Peter G. Kohler, Kohler, Wis.

[73] Assignee: Kohler General Corporation, Sheboygan Falls, Wis.

[21] Appl. No.: 730,300

[22] Filed: May 3, 1985

[51] Int. Cl.[4] ..... B22C 9/04; B22C 25/00; B22D 47/02

[52] U.S. Cl. ..... 164/18; 164/34; 164/130; 164/137; 164/167; 164/324

[58] Field of Search ..... 164/34, 35, 36, 4.1, 164/456, 130, 137, 18, 167, 324

[56] References Cited

U.S. PATENT DOCUMENTS

| | | | |
|---|---|---|---|
| 2,134,117 | 10/1938 | Floyd et al. | 164/130 X |
| 4,121,646 | 10/1978 | Rikker | 164/456 |
| 4,224,979 | 9/1980 | Rosin et al. | 164/130 |

*Primary Examiner*—Nicholas P. Godici
*Assistant Examiner*—J. Reed Batten, Jr.
*Attorney, Agent, or Firm*—Andrus, Sceales, Starke & Sawall

[57] ABSTRACT

A production casting line includes a foam pattern former producing destructible foam patterns for the forming of cast parts. A pattern clusters inventory station is provided immediately adjacent to the process line having a plurality of different preformed foam pattern clusters which are immediately available for introduction and insertion into the production line by interposing of the same into the process line. A substantial number of different patterns are stored. The foam patterns are stable, can be inventoried for long periods and are relatively inexpensive. The versatility with the inventoried patterns increases the operating efficiency and reduce the overall cost of the manufacturing operation. The cast line includes flasks within the pattern clusters and are mounted at a receiving station. Sand is compacted about the foam pattern. Molten metal is introduced at a power station resulting in vaporization and destruction of the plastic pattern and filling of the cavity to duplicate the pattern in the metal. If a demand exists for an alternate inventoried part during a run of a part, the inventoried patterns are moved directly from inventory into the line without shut down. When the special run is completed, the system reverts to the scheduled run of a previous part.

6 Claims, 6 Drawing Figures

PLASTIC PATTERN CASTING SYSTEM AND METHOD OF CASTING

BACKGROUND OF THE PRESENT INVENTION

The present invention relates to a plastic pattern casting system and particularly to an EPS (Expanded Polystyrene) plastic foam pattern casting system for production of widely different components.

In manufacture of products, machines and mechanisms individual parts may be formed in various processes. Thus, certain parts may be machined or processed from stock material, while other parts may be formed of a cast metal. Various components and parts for various machines and products are more economically and easily formed as cast metal members. In the machining art, a production line may necessarily process a number of different components and parts. To adapt the production lines to various products, machine subunits have been developed for interpositioning into a production line so as to adapt the line to various manufacturing or casting processes and sequences.

The conventional method of forming cast parts involves various sand casting processes. A more recent development in the commercial field involves a foam pattern casting process in which a foam pattern is formed of expandable polystyrene plastic by known molding techniques. The formed pattern is embedded in a loose, unbonded sand mass with a sprue projecting upwardly out of the sand mass. Hot metal is introduced into the sand mass through the sprue and serves to vaporize the cavity defining pattern and fills the void, thereby reproducing of the foam molded pattern. The foam casting process include many advantages in cost reduction and simplification of the manufacturing process.

The scheduling of the foam casting process follows the same basic approach as that used in conventional sand casting. The foam patterns are produced in batches for a pouring run. The patterns are staged for the pouring run and inserted sequentially into the pouring line so that all the parts of a given configuration or size are produced together or in sequence. Upon completion of the run of such a part, the system is reorganized for the production of a different part Generally, any given production run is set to produce the part both for a particular demand as well as for inventory. Although such conventional practice has been widely adapted and satisfactorily adapted for mass production, the system may prevent maximum efficiency and usage of the manufacturing facility. Thus, even though a given part may be needed on a priority basis, a system established and running a relatively large production run of some other component or part will normally continue to complete that run as a practical consideration because of the time and cost involved to change or interrupt the system operation. This results in various manufacturers and/or users establishing a relatively large inventory of various parts to avoid the delays and costs associated with interrupting the on-line casting process. The casting process could use several subassemblies for interposing of such units in the various parts of production casting line. This of course would require significant fixed cost and special apparatus for interconnecting of various units into a casting line. To the best knowledge of the present inventor, such modified systems have not been used and the conventional approach is a standard procedure in the casting business.

In summary, the foundry of today, even with the high production machines which have been developed, is essentially a batch process. The reason for using the batch process approach is that the change over downtime and/or the difficulty of maintaining control of quality makes other processes uneconomical.

There therefore exists a significant and substantial need for an "on-demand" casting process in which the casting line is readily adapted to interposing of various casting schedules, and varying of the casting schedules to provide maximum efficiency of the overall manufacturing system.

SUMMARY OF THE PRESENT INVENTION

The present invention is particularly directed to a casting system which is particularly adapted for ready change in the mix of component parts being cast without significant interruption in the operation of the casting line.

In accordance with the present invention, the foundry is operated at the pouring line with an essentially total flexible manufacturing mode in which the pouring line is essentially transparent to the particular pattern being molded. The pouring line may then be made to directly respond to the demand in the high-value added function, and both finished goods inventory and work-in-process inventory may be significantly reduced or eliminated. Generally, in accordance with the embodiment of the present invention, the production casting line may consist of a foam pattern forming apparatus for on-line production of patterns for the forming of cast parts. A process line includes processing of the molded patterns and moving the patterns through a circuitous path between the mold forming station and the casting line. The casting line may be a conventional construction including a receiving or loading station at which the foam pattern is deposited within an appropriate casting container.

In accordance with a preferred construction of the present invention, a pattern clusters inventory station is provided immediately adjacent to the process line. A plurality of different preformed foam pattern clusters are inventoried in this staging area. The preformed pattern clusters are immediately available for introduction and insertion into the production line by interposing of the same into the process line. A substantial number of different patterns can be readily stored and moved into the production line at a minimal cost. The foam patterns are extremely stable and can be inventoried over relatively long periods with a high degree of reliability and safety. Further, the patterns are relatively inexpensive and do not significantly contribute to inventory cost or reduce the operating efficiency of the casting line, and in fact as a result of increasing the versatility of the line, significantly increase the operating efficiency and reduce the overall cost of the manufacturing operation. The patterns are relatively light weight and can be readily and immediately inexpensively handled for storage and removal of storage and insertion into the production line. The movement of the pattern clusters may use either a manual or an automated system.

In the cast line, casting sand is introduced into a container or flask and may be introduced under gravity flow conditions. The same sand is usable for anyone of the various parts to be formed. The container will normally be subjected to high frequency shaking to compact the sand about the foam pattern as the container moves from the receiving station. At a casting station, hot metal is introduced through the sprue into the foam pattern, resulting in vaporization of the plastic pattern and the filling of the cavity otherwise resulting by the metal to form the cast part. At the unloading station, the sand will be removed to expose the cast part which is then removed from the casting box or container. The casting box and the sand is of course recycled through the casting line for casting of subsequent parts in a continuous on-line production.

In operation of the system, the mold line is run in a normal sequence, with the mold forming apparatus operating to sequentially produce the plastic patterns when using an in-house hold forming line and introducing them into the processing line and then the casting line in accordance with standard casting procedure. If a demand exists for an alternate inventoried part, such inventoried patterns are conveniently removed directly from the inventory as needed and introduced into the production line. The mold forming unit, where used, can be retained in its existing state and either temporarily shut down or operated continually, with the formed pattern clusters inventoried. When the special run has been completed, the system reverts to the scheduled run of a component part.

In accordance with the teaching of the present invention, the casting line and system is constructed with an interposed inventory of preformed foam patterns corresponding to any one of a plurality of component parts. An automated conveyor or other transfer means is preferably provided between the inventory station and the accumulating line for the selective removal of the inventoried clusters.

The casting line in essence is transparent with respect to the particular part being cast. Consequently, the system can be operated essentially independently of the specification for a particular part to be passed through the line.

The present invention thus eliminates the problem of producing castings in batches for inventory and shipment requirements by permitting production of parts on demand, and with timely production and shipment without necessity for storing finished parts. The invention permits substantial reduction of work in process inventory and allows the application of a flexible manufacturing system to the sand casting process.

DESCRIPTION OF ILLUSTRATED EMBODIMENT

Figure 1:
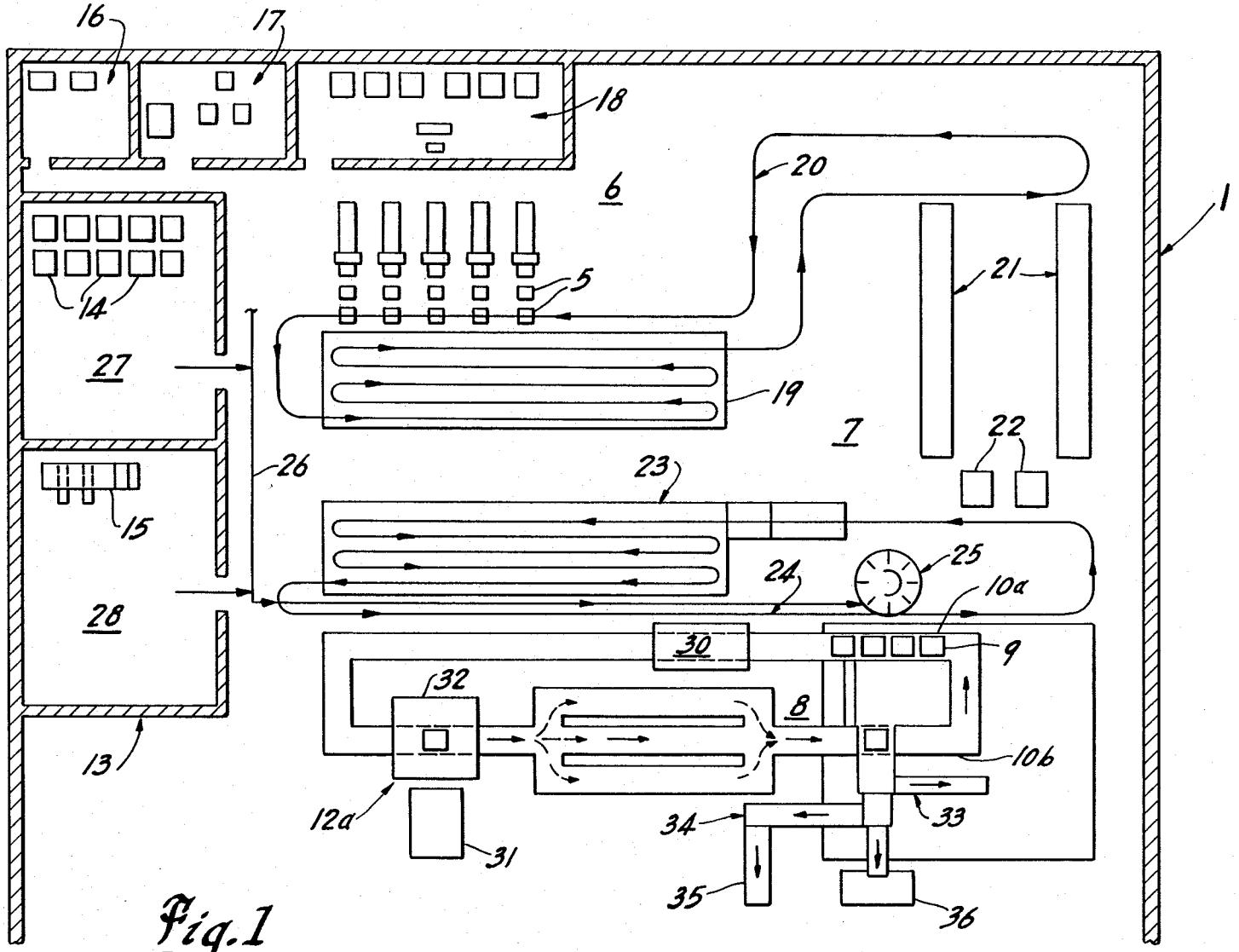
FIG. 1 is a diagrammatic of a casting room incorporating an embodiment of the present invention.
Figure 2A:
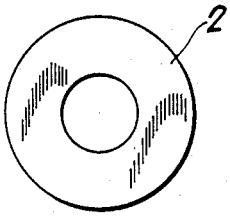
FIGS. 2*a* through 2*c* are elevational views of molded components adapted to be formed with the molding system illustrated in FIG. 1.
Figure 2B:
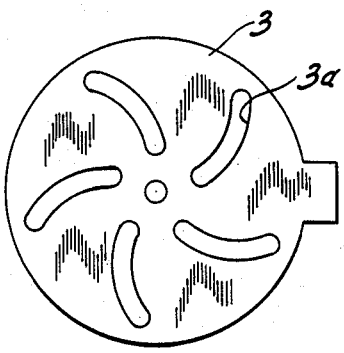
Figure 2C:
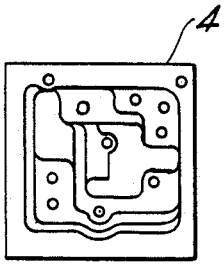
Figure 3:
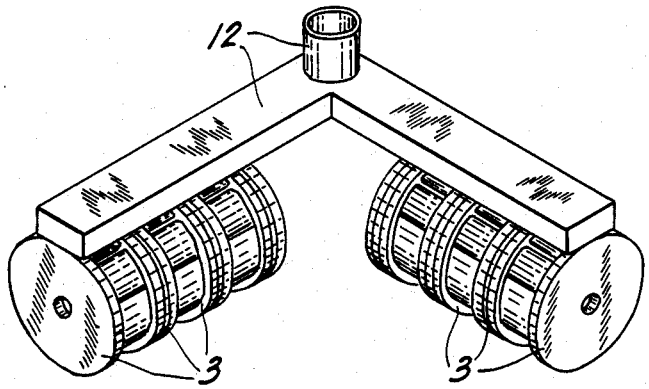
FIG. 3 is a view of a cluster of patterns for multiple part casting.
Figure 4:
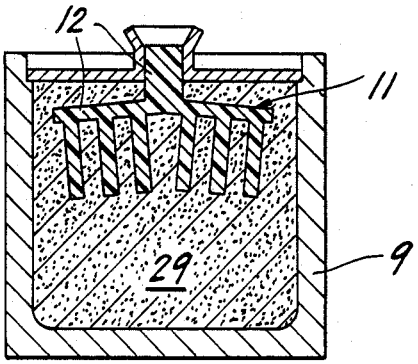
FIG. 4 is a vertical section through a casting container for the system shown in FIG. 1.

Referring to the drawing and particularly to FIG. 1, a lost foam casting room 1 is illustrated for mass casting of metal products. The metal products may be simple or complex forms cast members. For example, a simple annular ring member 2 such as shown FIG. 2*a* may be cast. A component part 3 such as a round plate having surface recesses 3*a* is shown in FIG. 2*b*. More complex multiple passage and recessed member 4 such as shown in FIG. 2*c* may be formed of a cast metal. The particular metal may of course be any of those presently used such as grey iron, steels, aluminum, brass, bronze, magnesium, stainless steel and others. A pattern 5 which is an exact duplicate of the final part such as shown in FIGS. 2*a* through 2*c* is formed. The part to be formed may be a single integral member formed with the pattern 5 at a pattern forming mold station 6 a precise duplicate of such part. A multiple element part may be formed by forming of separate mold patterns 5 at station 6 and joining the mold patterns to produce the duplicate of the part. The pattern 5 is formed of a polystyrene plastic or other suitable plastic which will vaporize upon contact within an appropriate high temperature metal. The present invention is particularly adapted to use with the lost foam casting process wherein the pattern is formed from expanded polystyrene particles or beads, and is described in connection with such a pattern forming process. The patterns formed at the mold station 6 are transferred to a treating and assembly station 7, prior to introduction into a continuous casting line 8 at which the metal product is formed by casting. The casting line 8 is a continuous carrousel-type line. A conveying mechanism, not shown, is adapted to transport a series of casting containers or flasks 9 between a loading station 10*a* and an unloading station 10*b*. Each flask 9 is similarly constructed as an opened top container. A pattern unit 11 is mounted within a flask 9, either as an individual peattern or as a cluster of a plurality of patterns connected to a common runner and a sprue 12, as shown in FIG. 3. The plastic pattern unit 11 is thus suspended within the flask 9 at the loading station 10*a* of line 8 for subsequent processing through a casting station 12*a* at which the heated molten metal is introduced into the sprue 12 to develop the final product or article.

The patterns 5 are continuously formed for any large run at the pattern forming station 6 and moved through the processing station 7 and the casting 8 line in a continuous production run.

In any given casting installation, however, the demand for the different parts or products may not be particularly adapted to continuous running of each part followed by the running of other parts. This is particuarly true in a jobbing foundry which services a number of different customers. The casting system, for example, may be set-up to run a large volumne of a particular part. During the run however, a demand may arise for a relatively small run of some other part. Generally, in conventional casting processes this presents a significant problem as the mold station and total line assembly must then be reorganized for the new part. This shutdown and reorganization of the system may not be economically efficient. The general practice is to inventory various parts so as to permit the operation of the casting line without interruption once set up for a given part.

In accordance with the present invention however, the casting system is made essentially transparent with respect to the product being cast, and an inventory of mold patterns is developed at a pattern inventory area or station 13. Individual patterns 14 may be inventoried at station 13 and/or clustered patterns 15 interconnected to an appropriate runner and sprue 12 may also be separately inventoried.

The mold pattern 5 for any given part depending upon the complexity of the part is generally only of 3% to 7% of the total cost of the finished product.

Thus by assembling an inventory of patterns 5, in contrast to the final product, savings on the order of 93% to 97% of inventory costs are obtained, as well as minimizing work-in-process. Thus if a run must be terminated or interrupted, a significant work-in-process is not idled during the alternate run. Further, the present invention by using inventoried molded patterns which are directly inserted into the casting line, permits changing of the process in real time and permits the protection of product on-demand and just-in-time for direct delivery. In summary, the casting system is a non-dedicated but integrated system in which the articles are molded and cast on a priority demand basis, without any basic change in production scheduling.

As more developed hereinafter, the variables in the system are essentially related to the pattern, the sand, the sand compaction function including direction, amplitude and time, the location of the sprue on the cluster, the location of the cluster in the flask, and the pour size or volume, required cooling time and location of cluster for picking or dumpout. Generally, with proper designs of the parameter, the product mix will require changes in the parameters relating to cluster location in the flask, the sand compaction function and the pour location and size. The parameters can be readily introduced, either manually or automatically by a suitable controller, using existing technology without interruption of the casting operation. For example, the system can be controlled by a suitable microprocessor interconnected into the various conveying mechanisms as well as the operating and control mechanisms conventionally used in a casting line. A host computer can monitor and control a plurality of different casting systems, with appropriate down loading to each system microprocessor. Each particular system continues to operate in an automated manner under normal production control. Upon demand of a particular part having preinventoried patterns, the system is automatically changed over with removal of the proper inventory patterns and insertion into the casting system. In summary, production is directly tied to the particular demand and needs without any significant change in the casting system.

More particularly in the illustrated embodiment of the invention, the pattern forming station 6 is diagrammatically illustrated as a known lost foam pattern forming molding assembly. The pattern forming apparatus includes a main supply 16 of raw polystyrene beads which are fed to a pre-expander and storage unit 17 for receiving and treating of the raw polystyrene beads for forming of the patterns. The processed beads are introduced into pattern molding machines 18 for forming a plurality of patterns, which are exact duplicates of the parts to be formed or a sub-component of such a part, as previously described. Because a casting line can sequentially cast the parts at a faster rate than a single molding machine would form the appropriate patterns a plurality of molding units or machines are generally used.

The molded patterns 5 are manually, or automatically, transferred, into the treating unit 7 for stablizing of each pattern and assembly of the patterns to the runners and sprue 12, individually or as a cluster for insertion into the casting line. Unit 7 includes a pattern curing oven 19 adapted to stablize shrinkage of the pattern. An endless loop conveyor 20 moves from the molding station 6 through the oven. The conveyor moves within the oven 19 in a serpentine path to hold the pattern in the oven for an appropriate time to thoroughly stablize the molded pattern. From the oven 19, the pattern 5 is transferred to a pattern assembly line 21, shown as a pair of parallel paths. The patterns 5 in the assembly lines 21 will be interconnected to define the pattern for a given complex part. For example, the part of FIG. 3 is a pump impeller consisting of two wall members interconnected by the vane cross members. The individual opposite walls are separately molded with lateral vane projections molded in one of the walls and aligned recesses in the other of the walls. The two molded parts are assembled with the elongated projections mating with the recesses and joined as by an adhesive to form a pattern which is the duplicate of the finished part. The pattern assembly lines terminate in a cluster assembly station 22, where the patterns are adhesively attached to a runner and sprue 12. A plurality of small patterns may be conveniently interconnected to a common runner and sprue 12, as shown in FIG. 3, for simultaneous formation of a plurality of the parts. When a relatively large part is being formed, a single pattern may be connected to the appropriate sprue for formation one at a time.

The assembled parts or cluster is transferred from the cluster assembly station 22 into a refractory coating oven 23. The molded pattern 5 is preferably coated with a permeable wash and dried. In the metal pouring step, the refractory coating separates the sand from the metal surface of the cast part and minimizes sand inclusion and sand defects.

A conveyor 24 transports the assembled patterns through the refractory oven and discharges the patterns to a cluster accumulating station 25 immediately adjacent to the loading station **10*a* of the casting line 8**.

The assembled and coated patterns within directly from station 25 or from the inventory unit 13, are mounted within the casting flask 9 at the casting loading station **10*a***.

To provide intermeshing of the on-line molded patterns 5 and the inventoried patterns 14 and 15, a suitable transfer line or conveyor unit 26 couples the several accumulating stations 25 of the casting system to the storage or inventory area 13. In the illustrated embodiment of the invention, the pattern inventoried area includes a single pattern storage room 27 and a cluster pattern storage room 28. The several rooms can of course store the appropriate individual patterns and clustered patterns in a appropriate storage environment for direct withdrawal and automated placement and removal from storage. The individual patterns 14 and the clustered patterns 15 may be totally finished and cured with the appropriate protection refractory coating.

The quality of the final product is directly related to the quality of the pattern. In fact, the quality of the pattern is considered one of the, if not the most significant, factors in the proper casting of high quality product. The patterns must be appropriately stored and controlled. However, the stablized patterns may be stored in any normal factory environment which does not create extreme temperatures or humidity. However, plastic molded patterns 5 are relatively light weight and very stable. The patterns are therefore conveniently and safetly handled, either manually or automatically by a suitable storage and retrieval mechanism. A suitable inventory control system should of course also be incorporated into the company records system. As such a mechanism may take anyone of a wide variety of different constructions, and can be readily provided by those skilled in the art, no particular further detail or description of such a mechanism is set forth.

Although the particular stage of formation of the stored pattern is not critical, greatest economy will probably be achieved by storing clusters, either coated or uncoated. In some designs, however, individual patterns may be molded, cured to stablize the part and then directly stored. The patterns are assembled, clustered, coated and dried for insertion into the casting line upon demand. Such final operations would then require corresponding flexibility, with the lost of economy associated with the normal batch forming of the clustered parts.

In any event, on-line molded or supplied patterns 5 and inventoried patterns 14 and/or 15 are introduced into the system from the mold station 6 and/or from the inventoried area 27–28 in accordance with priority production demand. When both the assembly line 7 and the casting line 8 are nondedicated units, the patterns can be introduced in any combination or sequence at the loading station 10*a*.

The support for the patterns including the runner and sprue 12 is located in the upper end of the top-opened flask with the pattern unit is freely suspended within the flask 9.

As the loaded flask 9 moves from the load station, it is filled with the fine molding sand 29. The sand is essentially a pure fine sand which pours into the flask 9 completely enclosing and embedding the pattern unit 11 including the runner and the inner portion of sprue 12. In the lost foam process, binders and other additives are not used in the sand, and thus the sand may be reused without special reprocessing. The sand 29 is compacted firmly around the pattern, normally by shaking of the flask 9 to settle the sand tightly into a more or less compact mass about the pattern. The compaction function may be executed during the filling as well as after the sand is introduced to cause the sand to flow into all voids and to lock the grains together.

Immediately downstream of the loading station 10*a*, the line 8 includes a suitable sand filling and compaction mechanism 30 of any suitable construction, at which the sand is introduced into the flask 9 and continuously compacted about the pattern. The sand filled flask moves from mass about the pattern. The flask moves from, the filled compacting mechanism 30 into the pour station 12*a*. A melting furnace 31 is provided at the pour station for melting of the appropriate metal. A transfer unit 32 transfers the appropriate quantity of the molten metal from the melt furnace 31 and discharges the hot metal into the sprue of the embedded pattern assembly.

In accordance with conventional practice as the metal moves into the flask and through the runner and the pattern, the hot metal vaporizes the molded plastic generating a metal-filled cavity within the sand, precisely corresponding to the original pattern. The progressively formed chamber is of course simultaneously filled with the cast metal to maintain the integrity of the cavity as now defined by the confining compacted sand.

The casting line 8 moves the filled cast metal flask 9 through a cooling staging area which may include a pluralty of different parallel paths as shown to allow variable cooling for different size castings, and then to the unloading station 10*b* where the flask 9 is diverted and turned to discharge the molded part and sand, as at 33 and 34. At the unloading station, the cast cluster can be picked or dumped onto a conveyor for separation from the sand. To pick the cast cluster from the flask, the sand is aerated to release the locked grains and to allow removal of the cluster prior to dumping of the sand. The cast part is inspected and either passed to a cleaning station 35 or to a reject station 36 to maintain quality control. The sand 29 is recycled back to the sand fill location for reuse. In the lost foam process, the sand is not significantly contaminated by the molding casting process and is readily recycled for reuse, as by cooling, classifying or removal metal process. Different casting metals may of course require different sands because of possible cross-contamination. As a general rule, ferrous metal and non-ferrous will require different sands. Certain metals such as brass, bronze and aluminum may, under certain conditions, use the same sand. The necessity for use of different sands will be readily known to those skilled in the art and properly provided, and no further discussion is therefore given herein. The only significant limitation on the assembly and introduction of various parts in the casting line 8 is related to the size of the flask. Thus in any given casting system, any combination or cluster of parts can be assembled and cast within the limitations dictated by the flask size.

In summary, the casting system may operate in the conventional procedures which have been in practice since the casting began wherein the patterns are formed at a mold station 6, suitably treated at a station 7 and then the casting formed at a casting station 8. The continuous in-line casting permits high speed and low cost production of any given part. When, however, a priority demand for another commonly formed part arises, the patterns 14 and/or 15 are appropriately removed from inventory and into the production line until the run is completed. The in-line casting is then resumed. The priority demand production may, of course, be inserted repeatedly as needed to maximize the system efficiency.

As previously noted, the significant variables in the unit relate to the pour time and the quantity of the metal required by the size of the parts. Further when casting or changing from one metal to another, care must be taken that the sand used is compatible with the metals used. Such variables are readily conveniently adjusted and monitored, either manually or in an automated line.

The present invention with the essentially transparent or non-dedicated casting system thus permits system operation at maximum efficiency, and in accordance with priority demand for the cast parts.

Various modes of carrying out the invention are contemplated as being within the scope of the following claims particularly pointing out and distinctly claiming the subject matter which is regarded as the invention.

I claim:

1. The method of casting different parts comprising, continuously operating a casting line with a casting container adapted to receive and individually support each of said cast parts, on-line forming and processing one-time patterns for direct on-line forming of one-time patterns for introduction into said casting line, preforming of one-time patterns for said parts, inventorying a plurality of selected ones of said preformed one-time patterns, and interposing of said inventoried preformed one-time patterns with said on-line formed patterns for continuous production of parts including different parts on a priority demand basis without interruption of operation of the casting line.

2. A casting system comprising, a pattern forming station adapted to form a plurality of individual destructible patterns of a part from a plastic material, an assembly station for interconnecting of said individual destructible patterns to a runner and sprue to form pattern clusters, a series of flasks each adapted to receive at least one cluster, means for filling of each flask with sand to totally embed the pattern cluster with said sprue exposed, means for introducing molten metal into said sprue, said patterns being totally destroyed by and replaced by said molten metal to form a duplicate part of said pattern, a casting line for sequentially transferring said flasks through said means to fill each flask with sand and said means to introduce molten metal into said sprue, an inventory unit including a plurality of different plastic destructible patterns corresponding to finished parts, and means for selectively introducing said destructible patterns from said pattern forming station and from said inventory unit to provide a continuous production of different pattern duplicate parts on said casting line.

3. The casting system of claim 2, including a conveying means for transfer of patterns from said inventory unit to said casting line.

4. The system of claim 2 wherein said inventory unit includes a first inventory of individual patterns to be assembled to define a product and a second inventory of preassembled pattern clusters, and selectively withdrawing of said individual patterns from said first inventory and each cluster from said second inventory on a priority demand basis.

5. The casting system of claim 4, including a conveying means coupled to said casting line and to said inventory unit for selectively withdrawing of individual patterns from said first inventory and clusters from said second inventory.

6. A lost foam metal casting system, comprising a lost foam pattern forming means for forming destructible patterns, a pattern stablizing means, a pattern processing means connected to said stablizing means and including a pattern assembly means and pattern coating means, a casting line having a series of open top containers for receiving said destructible patterns within a compacted sand means for lost foam casting of metal parts, and an inventory of different destructible foam patterns for direct insertion between said casting line and said pattern processing means for establishing a continuous operation of said casting line with interpositioning of said on-line formed patterns and said inventoried destructible patterns.

* * * * *